US008757425B2

(12) United States Patent
Copeland

(10) Patent No.: US 8,757,425 B2
(45) Date of Patent: Jun. 24, 2014

(54) BEVERAGE CONTAINER

(75) Inventor: Bruce Copeland, Stone Mountain, GA (US)

(73) Assignee: Williams Industries, Inc., Shelbyville, IN (US)

( * ) Notice: Subject to any disclaimer, the term of this patent is extended or adjusted under 35 U.S.C. 154(b) by 553 days.

(21) Appl. No.: 12/560,834

(22) Filed: Sep. 16, 2009

(65) Prior Publication Data

US 2011/0062171 A1 Mar. 17, 2011

(51) Int. Cl.
*A47G 19/00* (2006.01)

(52) U.S. Cl.
USPC ..... 220/713; 220/711; 220/703; 220/694; 220/769; 220/829; 220/752; 215/398; 215/235; 222/470; D7/619; D7/620; D7/621; D7/622; D7/319; D8/320; D8/321

(58) Field of Classification Search
USPC ..... 220/713, 711, 703, 694, 769, 254, 829, 220/752; 215/398, 235; D7/619–622; 222/470
See application file for complete search history.

(56) References Cited

U.S. PATENT DOCUMENTS

| | | | | |
|---|---|---|---|---|
| 2,944,691 | A * | 7/1960 | Serio | 215/235 |
| 5,242,093 | A * | 9/1993 | Worrell et al. | 222/470 |
| 6,242,093 | B1 * | 6/2001 | Ferguson | 428/367 |
| 2009/0188929 | A1 * | 7/2009 | Sims et al. | 220/710 |

* cited by examiner

*Primary Examiner* — Anthony Stashick
*Assistant Examiner* — Cynthia Collado
(74) *Attorney, Agent, or Firm* — Barnes & Thornburg LLP

(57) ABSTRACT

An illustrative beverage container having a handle defining multiple gripping portions is disclosed.

16 Claims, 2 Drawing Sheets

BEVERAGE CONTAINER

FIELD OF THE INVENTION

The present invention relates generally to a beverage container, and more specifically to a beverage container having multiple gripping portions.

BACKGROUND OF THE INVENTION

Beverage containers may have a handle. Typically such handles are "C" shaped, having two ends affixed to the body of the container to form a closed grip. Another type of handle is one that is affixed at one end of the container and then extends outwardly and down in the manner of an upside down "L" to form an open grip With these arrangements, a user may grip the handle as is, which might not be suitable for that user's hand. What is needed is a grip that allows for multiple ways to grip the container.

SUMMARY OF THE INVENTION

The present invention may comprise one or more of the following features and combinations thereof. A beverage container comprises a body having a top portion and a bottom portion. The top portion illustratively includes an annular lip defining a mouth or opening through the top portion. The opening may be thought of as a mouth. Illustratively, the body has a handle arcing outwardly and downwardly away from the top portion of the body towards the bottom portion. The handle illustratively defines an open gripping portion and a closed gripping portion. The handle may also define a second closed gripping portion. The gripping portions or hollows may be ergonomic. The lip may have a drinking portion that extends further upwardly and beyond the opening or mouth relative to the rest of the lip. The handle may be disposed on the body generally at a location circumferentially displaced from the drinking portion. A lid may, but need not be included. The lid illustratively may be received within and may generally cover the opening. The lid may include a tab. The lid illustratively may further include a drinking aperture extending therethrough in fluid communication with the mouth or opening. When the lid is received within the opening, the drinking aperture and the drinking portion illustratively are adjacent to one another. Illustratively, when the lid is received within the opening or mouth, the tab and the drinking portion are circumferentially displaced from one another. For example and without limitation they may be generally opposed to one another. The tab may be used to place, as for example by a press-fit or snap-fit, and/or remove the lid from the mouth. Thus, a user may apply pressure or force to the tab may to either join together or separate from one another the lid and the beverage container. In addition to, or in lieu of the drinking aperture, the lid may move from a closed position covering the mouth or opening to an open position wherein at least a portion of the opening is uncovered to allow a user to drink directly through the opening. The separation from one another may be entirely such that the mouth is wholly uncovered by the lid, or partially such that at least a portion of the mouth or opening is uncovered. If desired, the lid may be omitted altogether to allow a user to drink directly through the mouth or opening. Illustratively, the body is generally cylindrical, but could comprise any other desired shape. The components may be fashioned out of any suitable material by any method of manufacture suitable to the selected material.

These and other objects of the present invention will become more apparent from the following description of the illustrative embodiment.

DESCRIPTION OF THE ILLUSTRATIVE EMBODIMENTS

Figure 1:
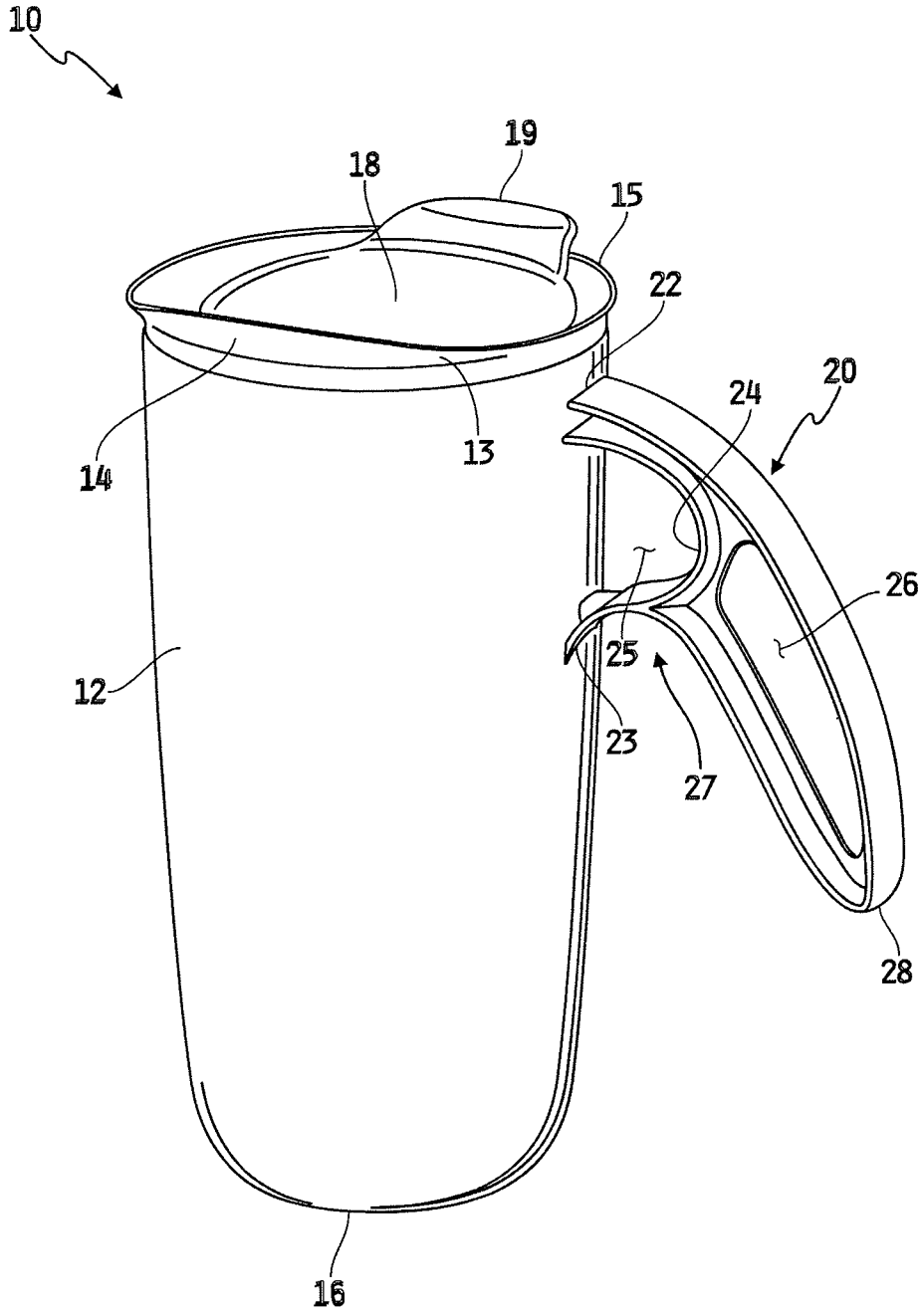
FIG. 1 is a perspective view of an illustrative beverage container.

For the purposes of promoting an understanding of the principles of the invention, reference will now be made to a number of illustrative embodiments illustrated in the drawings and specific language will be used to describe the same.

Figure 2:
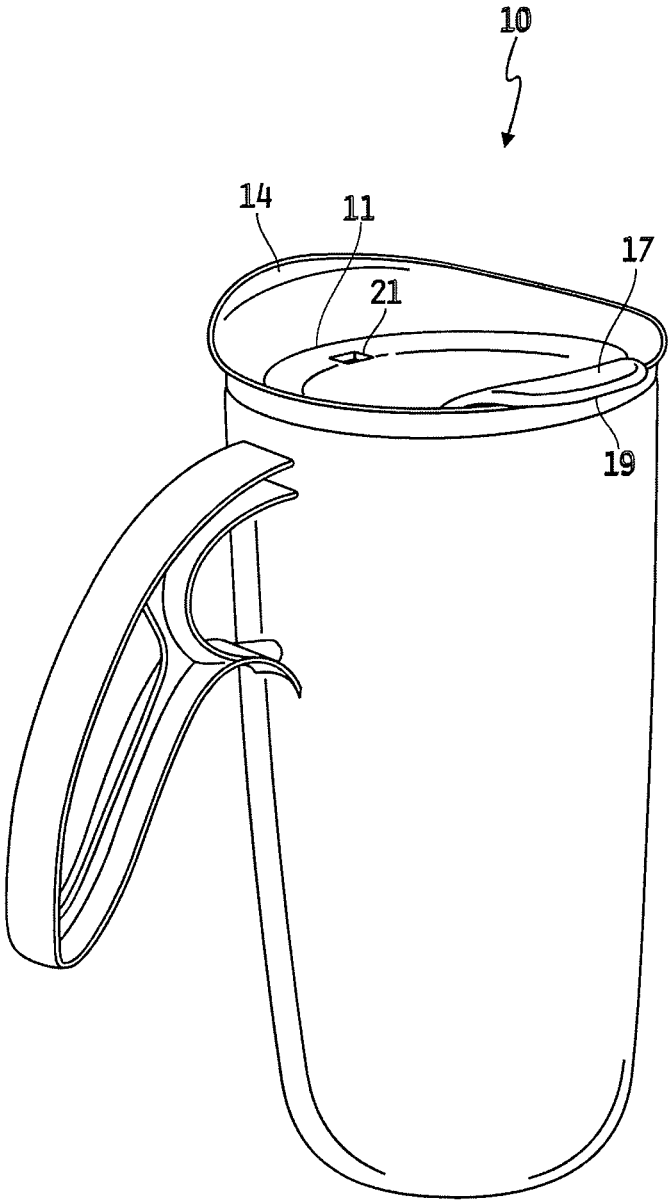
FIG. 2 is another perspective view of the illustrative beverage container.

Referring to FIG. 1 and FIG. 2, a beverage container 10, which may also be referred to as a mug, cup, drinking container or the like, generally comprises a body 12 having a closed bottom 16 and an opening, open mouth or top portion 11 opposite the bottom 16. The top portion includes an annular lip 13 extending circumferentially around the container body 12 to define the mouth 11. The container illustratively is configured to receive and dispense a beverage or other liquid through the mouth. The lip 13 may include a drinking portion 14 that extends further upwardly above the mouth than the other portions 15 of the lip 13. The drinking portion 14 may also extend further outwardly beyond the mouth relative to the other portions 15. The container 10 may be fitted with a lid 18 that substantially covers the mouth 11. The lid may be formed to fit snugly within the lip, as for example and without limitation by a snap-on or press fit. The body 12 and the lid 18 may also be screwed together or coupled together by any other suitable means. In one illustrative embodiment, the lid may define a drinking aperture 21 opening or extending through the lid 18 in fluid communication with the opening or mouth 11. As best seen in FIG. 2, the drinking aperture 21 illustratively is located near the drinking portion 14. For example and without limitation the drinking aperture 21 and the drinking portion 14 illustratively are adjacent to one another. Illustratively, the lid 18 may be configured to provide tight and defined placement over the mouth 11. The drinking aperture may comprise any suitable shape including for example and without limitation a square, a rectangle, a circle, an oval, a slit or any other generally ovate or polygonal shape. The lid illustratively includes a tab 19. The tab 19 may be configured to aid a user in holding and/or using the container 10. The tab 19 may also aid a user in inserting the top over and/or removing the top from the opening. In another illustrative embodiment, the lid 18 may be movable, as for example and without limitation by pivoting, from a closed position in which the mouth 11 is completely covered and no liquid can escape, to an open position (not shown) in which at least a portion the mouth or opening 11 is uncovered to allow liquid to flow directly in or out of the container 10 through the mouth 11. The tab 19 may be configured to allow a user to apply pressure to a manipulation portion 17 of the tab 19 to join together or separate from one another, in whole or in part, the container 10 and the lid 18. Illustratively, the lid 18 and the container 10 may be joined together in a defined relationship such that the drinking portion 14 of the lip and the tab 19 are circumferentially displaced from one another. For example and without limitation the drinking portion 14 and the tab 19 are in a generally opposed relationship when properly joined together. The drinking portion 14 is configured to accommodate a user's mouth to aid in drinking from the container. In yet another illustrative embodiment (not shown), the lid 18 may be omitted entirely leaving the opening 11 completely uncovered. In such a configuration, a user would drink directly through the opening 11 and could, but need not use the drinking portion 14. For example, a user could drink from anywhere around the circumference of the mouth or opening 11. The container illustratively includes a handle 20 having an upper or first portion 22 and a lower or second portion 23 each of which is connected to the body 12 (as seen in FIG. 1 upper portion 22 connects to container 12 at first connection 30 and lower portion 23 connects to container 12 at second connection 31) and generally extends or arcs at an angle outwardly away from the body 12 and downwardly away from the mouth toward the bottom 16 until the upper and lower portions 22, 23 meet at the handle tip 28. The lower portion 23 illustratively arcs upwards before arcing downward to form an ergonomic hollow for a user's hand. It will be understood that the handle 20 can be located just about anywhere on the body so long as it is circumferentially displaced from the drinking portion by some degree. Illustratively, the handle 20 is disposed between the drinking portion 14 and the tab 19. Thus, the drinking portion 14 is circumferentially displaced from the handle 20. For example and without limitation the drinking portion 14 may be circumferentially displaced from the handle 20 an amount less than about plus or minus 180 degrees. In a further non-restrictive example, the drinking portion 14 and the handle 20 may be generally perpendicular to one another or circumferentially spaced about 90 degrees from one another. The lower portion 23 defines an open gripping hollow or portion 27 that has an upper portion that is closer to the body 12 relative to a lower portion that ends at the tip 28. The lower portion of the gripping hollow 27 is unbounded or open. The hollow 27 tapirs inwardly from the tip 28 to the body 12 such that the hollow is wider at its bottom near the tip than it is at its top near where the lower portion 23 meets the body 12. The handle further comprises a middle member 24 disposed generally laterally or transversely between the upper and lower portions 22, 23 to define a closed gripping hollow or portion 25 and another closed gripping hollow or portion 26, therebetween. Closed gripping hollow 25 illustratively is defined by upper portion 22, lower portion 23 and one side of middle member 24. Closed gripping hollow 26 illustratively is also defined by upper portion 22, lower portion 23 and the other side of middle member 24.

Each of the gripping hollows 25, 26, 27 is configured to allow a user to grip the container 10 in a different manner or manners chosen by the user. For example, a user may slip their hand up through the open-ended gripping hollow 27 to grab the entire handle 20, may wrap their hand around the entire handle 20 as if the hollow were closed, may insert one or more fingers through either of the closed gripping hollows 25, 26, may wrap their hand around the body 12, may wrap one hand around the body and grab the handle 20 or one of the hollows 25, 26, 27 as described above, or may grip the container 10 using a combination of any of the foregoing. The gripping hollows 25, 26, 27 also serve to reduce the overall weight of the container while adding strength to the handle. Each of the gripping hollows 25, 26, 27 illustratively may be ergonomic.

Illustratively, the body 12 is generally cylindrical, although it may be formed to any desired shape. The illustrative beverage container 10 may be fashioned from any suitable material including for example and without limitation plastic, metal, glass, ceramic or some other material including without limitation a composite material. The container may be molded as an integral unit, or the various components may be formed separately and connected together as desired. Any means of manufacture suitable for the selected material may be used. Illustratively, the container 10 may be injection molded.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected.

What is claimed is:

1. A beverage container comprising:

a body having a top portion and a bottom portion;

the top portion having an annular lip defining an opening through the top portion; and a handle arcing outwardly and downwardly away from the top portion;

wherein the handle defines an open gripping portion and a closed gripping portion; and wherein the handle further defines a second closed gripping portion, wherein the handle includes a first portion beginning at a first connection to the container and extending downward and away from the container and downward toward the bottom of the container to a handle tip, and a second portion extending from the handle tip upward and inward toward the container to a connection with a middle member and then downward from the middle member and toward the container until the second portion is joined at a second connection to the container and wherein the middle member joins the first portion and second portion between the handle tip and the first and second connections to the container.

2. The beverage container of claim 1 wherein the lip has a drinking portion that extends further upwardly and beyond the opening relative to the rest of the lip.

3. The beverage container of claim 2 wherein the handle is circumferentially displaced from the drinking portion.

4. The beverage container of claim 3 further comprising a lid generally covering the opening.

5. The beverage container of claim 4 wherein the lid includes a drinking aperture extending through the lid in fluid communication with the opening.

6. The beverage container of claim 5 wherein the lid is configured to move to uncover at least a portion of the opening.

7. The beverage container of claim 6 wherein the lid includes a manipulation tab.

8. The beverage container of claim 7 wherein the manipulation tab is configured to separate the beverage container and the lid from one another.

9. The beverage container of claim 8 wherein the body is generally cylindrical.

10. The beverage container of claim 9 wherein the container is fashioned out of plastic.

11. The beverage container of claim 1, wherein the drinking portion and the handle are circumferentially displaced from one another by between about five (5) degrees and about 175 degrees.

12. A beverage container comprising:

a body having a closed bottom and an open mouth opposite the bottom;

an annular lip extending circumferentially around the container body to define the mouth;

the lip including a drinking portion extending further upwardly above and beyond the mouth than other portions of the lip;

a handle having an upper portion extending from the container body to a tip, the handle being circumferentially displaced from the drinking portion;

the handle having a lower portion extending from the tip toward the container body;

a middle member extending transversely between the upper and lower portions to define a first closed gripping hollow and a second closed gripping hollow therebetween; and wherein the lower portion defines a downwardly opening gripping hollow between the lower portion and the body, the downwardly opening gripping hollow having a highest point from which the gripping hollow extends downward toward the container in one direction and downward toward the tip in an opposite direction.

13. The beverage container of claim 12 further comprising a lid having a manipulation tab.

14. The container of claim 13 wherein the lid covers the mouth and defines a drinking aperture extending therethrough in fluid communication with the mouth.

15. The container of claim 14 wherein the lid is movable to uncover at least a portion of the mouth.

16. The beverage container of claim 1 wherein the first portion joins the second portion at an acute angle.

* * * * *